US005738914A

United States Patent [19]

MacMillan

[11] Patent Number: 5,738,914

[45] Date of Patent: Apr. 14, 1998

[54] ELECTROLESS METAL PLATING SOLUTION

[75] Inventor: John A. MacMillan, Wirral, United Kingdom

[73] Assignee: The Associated Octel Company Limited, London, England

[21] Appl. No.: 669,302

[22] PCT Filed: Nov. 9, 1995

[86] PCT No.: PCT/GB95/02633

§ 371 Date: Sep. 13, 1996

§ 102(e) Date: Sep. 13, 1996

[87] PCT Pub. No.: WO96/15290

PCT Pub. Date: May 23, 1996

[30] Foreign Application Priority Data

Nov. 11, 1994 [GB] United Kingdom ..... 9422762

[51] Int. Cl.[6] ..... B05D 1/18

[52] U.S. Cl. ..... 427/437; 427/443.1; 106/1.13; 106/1.23; 106/1.26

[58] Field of Search ..... 427/437, 443.1; 106/1.13, 1.23, 1.26

[56] References Cited

U.S. PATENT DOCUMENTS

| | | | |
|---|---|---|---|
| 3,158,635 | 11/1964 | Kezerian et al. | 260/429 |
| 4,704,233 | 11/1987 | Hartman et al. | 252/527 |
| 5,316,898 | 5/1994 | Ueda et al. | 430/400 |
| 5,569,443 | 10/1996 | Wilson et al. | 423/576.6 |

*Primary Examiner*—Benjamin Utech

*Attorney, Agent, or Firm*—Fay, Sharpe, Beall, Fagan, Minnich & McKee

[57] ABSTRACT

An electroless metal plating solution comprising metal ions to be reduced for plating onto a substrate and a chelate for the metal to prevent or reduce metal hydroxide precipitates forming and to buffer the amount of metal ions available for reduction, wherein the chelate is at least ethylene diamine disuccinic acid (EDDS).

12 Claims, 7 Drawing Sheets

ELECTROLESS METAL PLATING SOLUTION

The present invention relates to the use of a compound. In particular, the present invention relates to the use of ethylene diaminedisuccinic acid "EDDS ".

BACKGROUND OF THE INVENTION

Electroless plating solutions are used to deposit metals on to substrates. The electroless plating process is very, sensitive and dependent on many factors such as the stability of the complexant and the resultant complexes used to deposit metals on substrates. In addition, the crystallinity, the homogeneity and the adherence of the deposited metal films are dependent on factors such as the stability constant of the complexant used.

A commonly used electroless plating solution is an electroless copper plating solution. In a typical process, a substrate, such as a circuit board, is placed in a solution of copper ions. At the metal/solution interface copper ions are reduced and copper is then "deposited" on to the substrate.

However, there are problems with electroless copper plating solutions. For example, copper hydroxide precipitates can be formed at high pH. Also, copper metal will homogeneously nucleate when present in solutions containing high levels of copper ions. Moreover, if the rate of deposition in the coating process is too fast one can get an uneven and/or an inadherant coating which, for some applications, is undesirable. Also, if excessive copper ions are deposited uncontrollably, the life of the plating solution is reduced and the process will become inoperative if there are no free copper ions.

In order to try to overcome these problems a chelating agent is added to the electroless copper plating solution to restrict the levels of free copper ions. A typical chelating agent is EDTA (ethylene diamine tetra-acetic acid).

Whilst EDTA may reduce to some extent the onset of copper hydroxide precipitation and control the level of copper deposition, it does suffer from the drawback that it is non-biodegradable. The manufacturer of, for example, circuit boards is then faced with the problem of how to remove the EDTA prior to disposal of the rinse water.

The present invention seeks to overcome the problems associated with the use of EDTA in electroless metal plating processes.

SUMMARY OF THE INVENTION

According to a first aspect of the present invention there is provided an electroless metal plating solution comprising metal ions to be reduced for plating on to a substrate and a chelate for the metal ions to prevent or reduce metal hydroxide precipitates forming and to buffer the amount of metal ions available for reduction, wherein the chelate is at least EDDS.

According to a second aspect of the present invention there is provided a process of plating a substrate with a metal comprising exposing the substrate to the electroless metal plating solution as defined above.

According to a third aspect of the present invention, there is provided the use of EDDS in an electroless metal plating solution as a biodegradable chelate.

The term "EDDS" includes racemic EDDS or optically active isomers thereof, such as (s,s)EDDS, and active salts and active derivatives thereof. Preferably the term means (s,s)EDDS or salts thereof. Preferably the EDDS is (s,s)

EDDS. More preferably the EDDS is (s,s)EDDS as prepared by the process of PCT/GB94/02397 filed 2 Nov. 1994.

Suitable metals to be reduced include nickel and copper.

Preferably the metal to be reduced is copper.

The term "active" means the ability to prevent metal hydroxide precipitates forming and to buffer the amount of metal ions available for reduction, but also have the property of being biodegradable.

The term "at least EDDS" means that other chelates may be present. Preferably the chelate is EDDS alone.

The term "substrate" includes integrated circuits, circuit boards, conductor circuits on printed circuit boards and ceramic substrates, electromagnetic wave shielding for telecommunication applications and engineering substrates.

In more detail, the present invention is based on the surprising discovery that the use of EDDS, which is biodegradable, prevents metal hydroxide precipitates forming and buffers the amount of metal ions available for reduction to an acceptable level, which level is at least comparable to the level achieved by use of EDTA.

The use of biodegradable EDDS in electroless metal plating solutions is further advantageous as good growth rates of the metal on the substrate are achieved, which rates are comparable to those with the use of EDTA. The use of EDDS in electroless metal plating solutions is even further advantageous as the metal plating solution is at least as stable as metal plating solutions comprising EDTA.

BRIEF DESCRIPTION OF THE DRAWINGS

The present invention will now be described only by way of example, in which reference shall be made to FIG. 1 which shows the formula of EDDS.

Reference is also made to FIGS. 2–3 which are activation energy plots.

Figure 4:
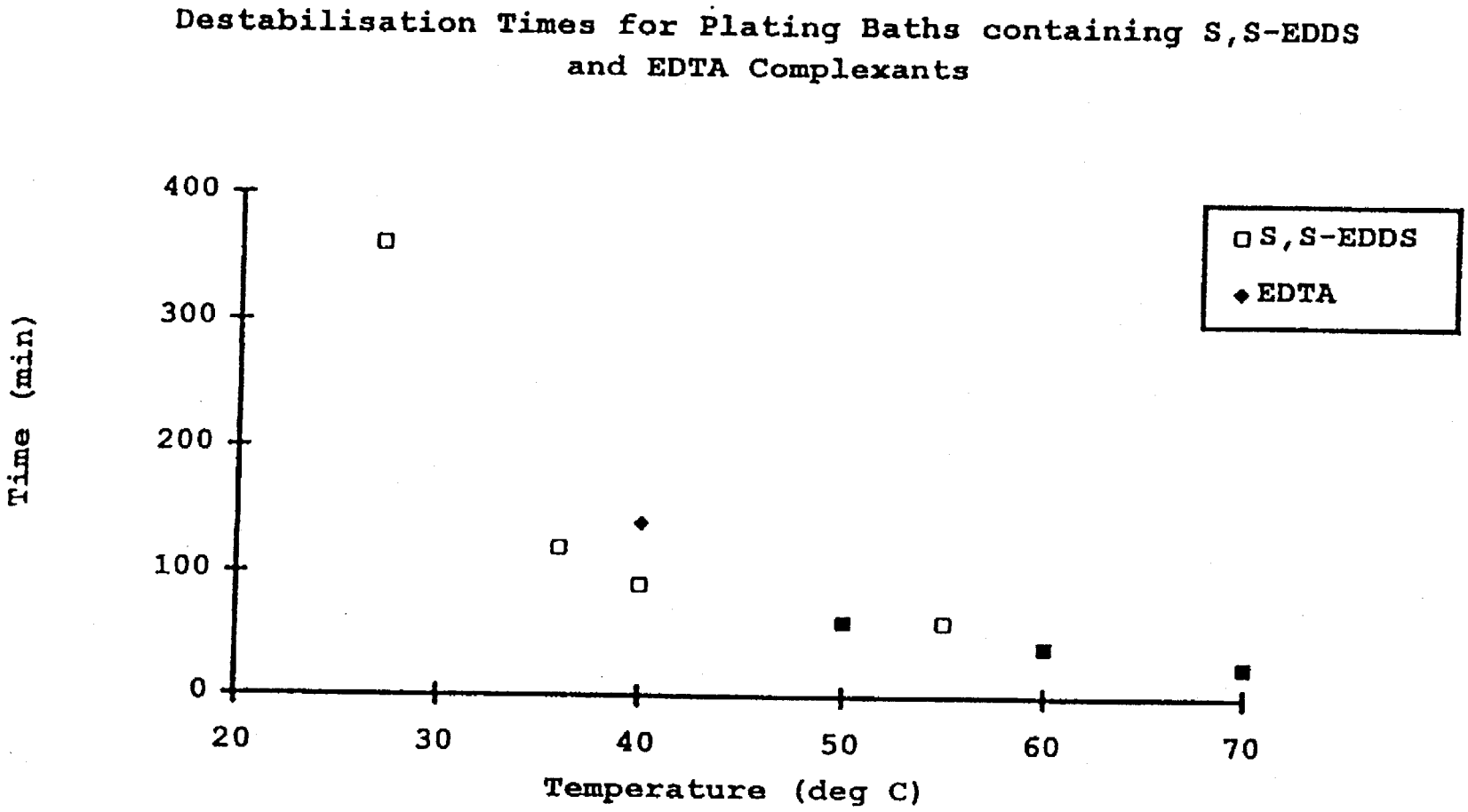
Figure 5:
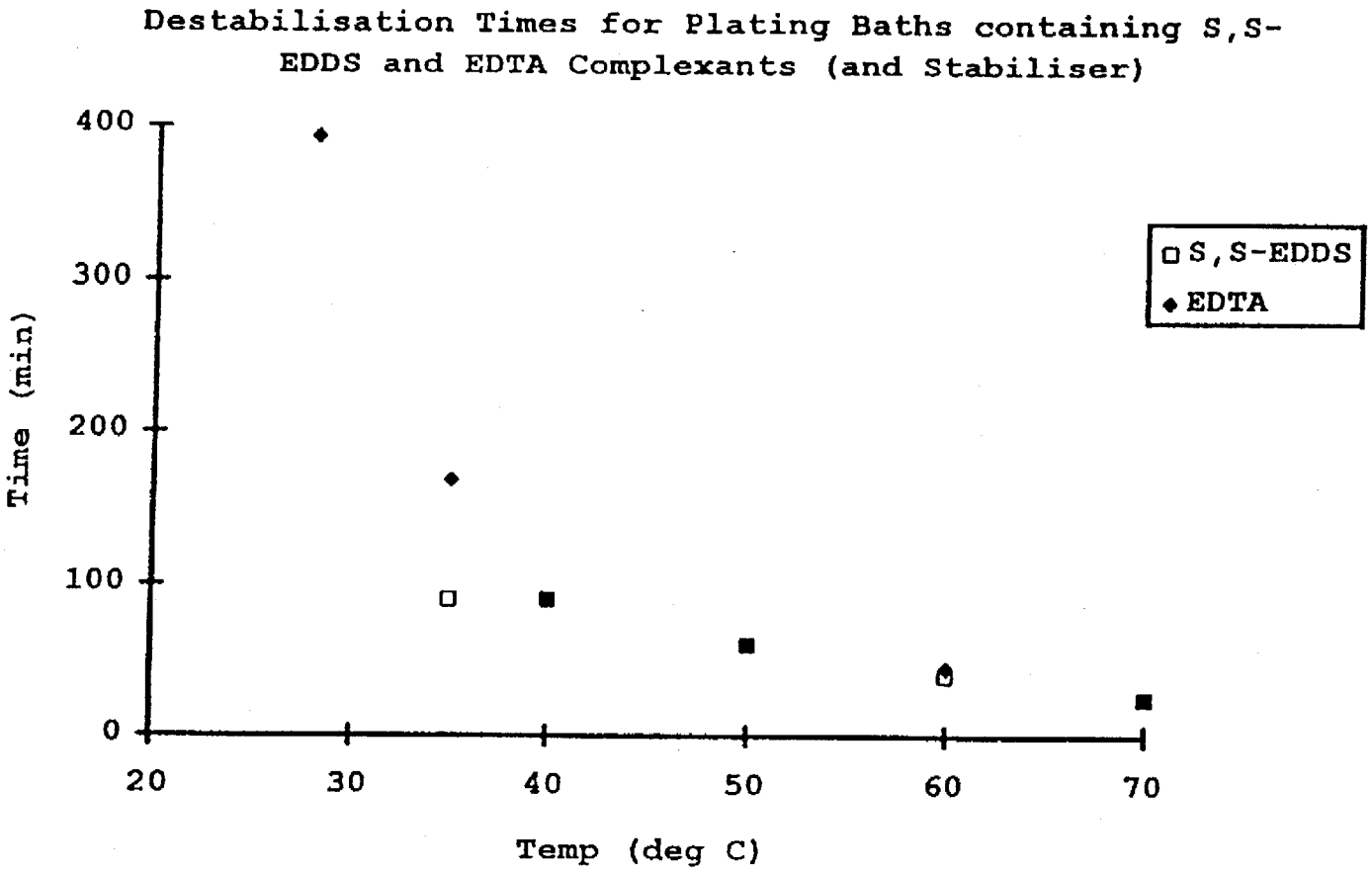

Reference is also made to FIGS. 4–5 which are plots of stabilisation studies.

Figure 6:
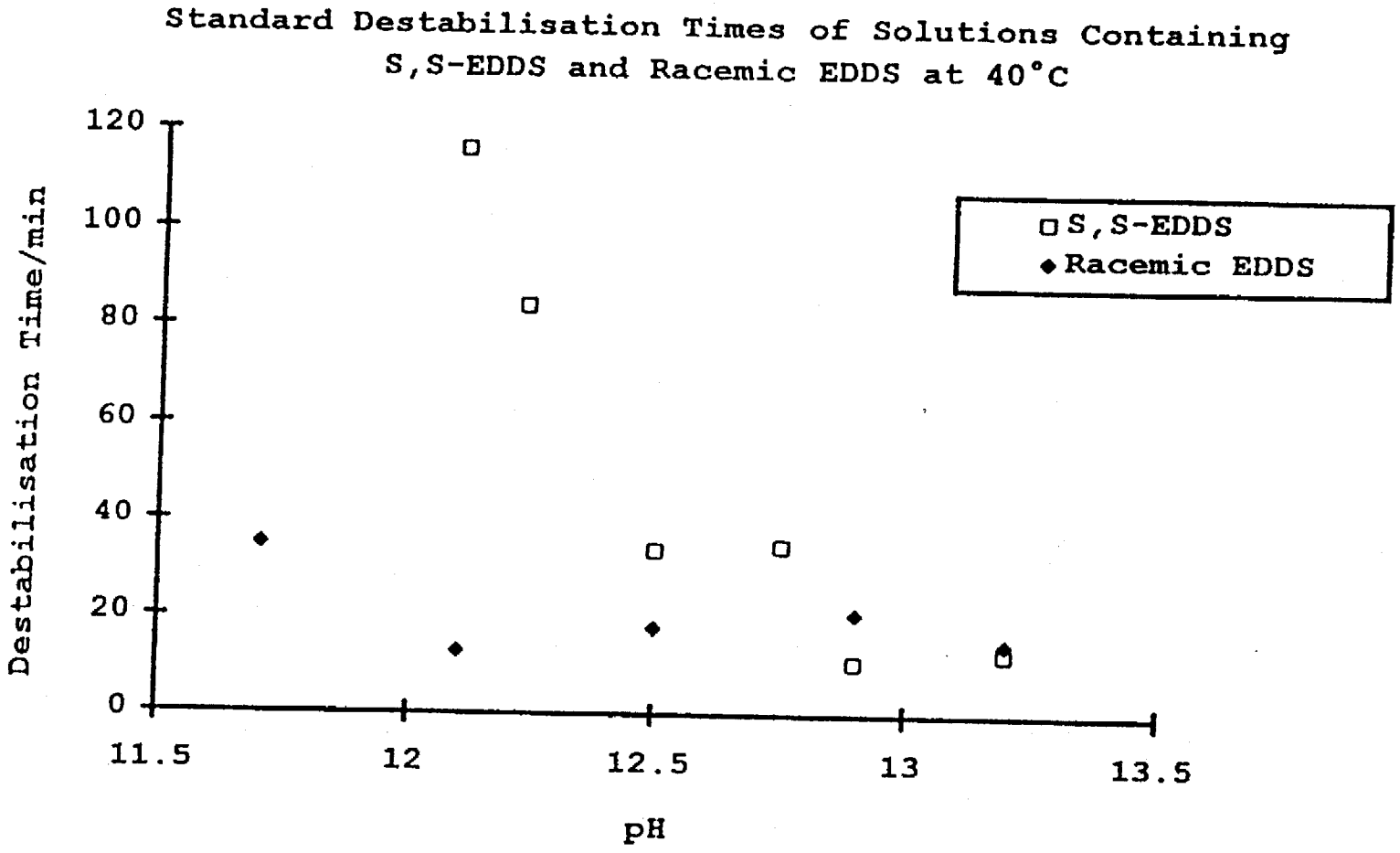
Figure 7:
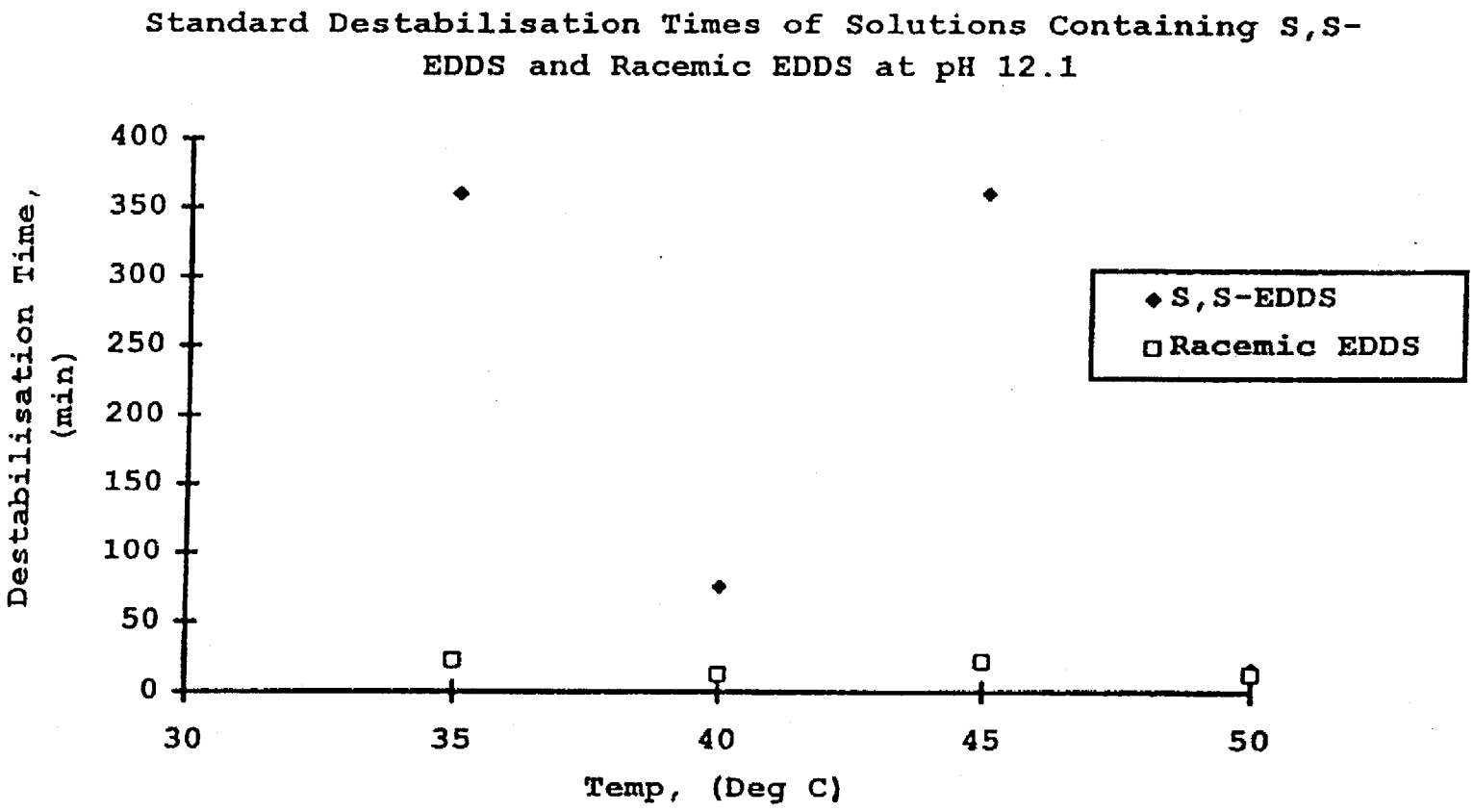

Reference is also made to FIGS. 6 and 7 which are plots of destabilisation times obtained from screening experiments.

DETAILED DESCRIPTION

EDDS

Figure 1:
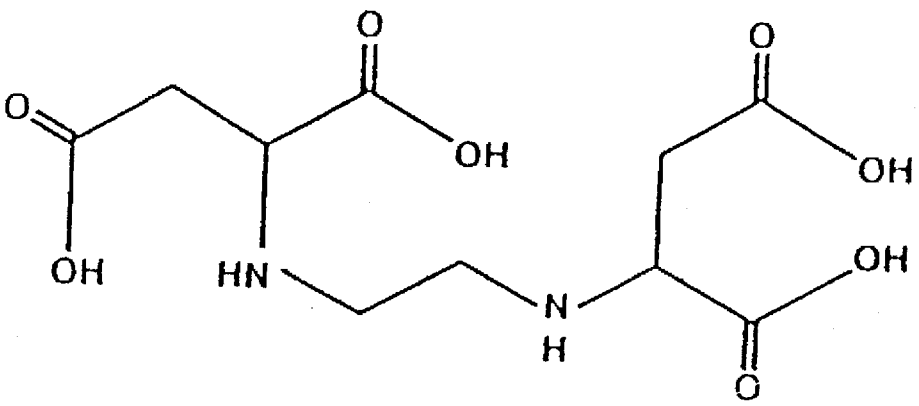
Figure 2:
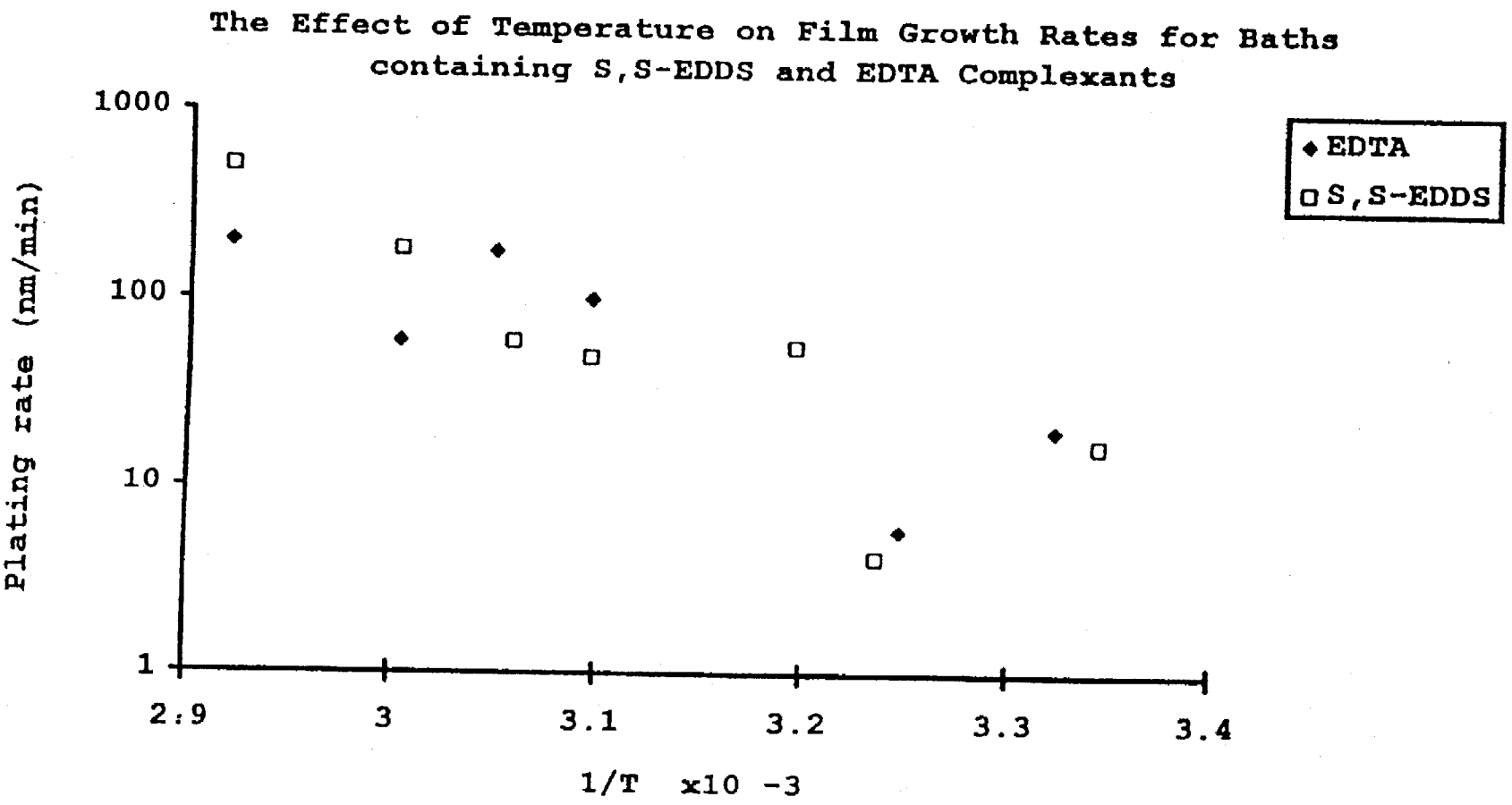

The structure of EDDS is shown in FIG. 1.

PREPARATION OF EDDS

A preferred method for making EDDS is disclosed in co-pending PCT patent application No. PCT/GB94/02397 filed 2 Nov. 1994.

In short, PCT/GB94/02397 discloses a process for the preparation of amino acid derivatives in free acid or salt form, in which the nitrogen atoms of two or more amino acid molecules are linked by a hydrocarbonyl or substituted hydrocarbonyl group, which comprises reacting, in an aqueous medium at a pH in the range 7–14, a compound of the formula X—A—Y where X and Y are halo atoms which may be the same or different and A is a hydrocarbyl or substituted hydrocarbonyl group, in which X and Y are attached to aliphatic or cycloaliphatic carbon atoms, with an amino acid (or salt thereof), wherein the reaction is carried out in the presence of dissolved cations of an alkaline earth metal or of a transition metal.

For example, (s,s)EDDS may be prepared according to the following teachings, in which DBE means 1,2-dibromoethane, and (s,s)EDDS means (S,S)-ethylene diaminedisuccinic acid.

A reaction mixture containing 150.1 g L-aspartic acid, 140.0 g of 50% aq. NaOH, and 210.9 g water at a pH of 10.2 at 25° C. together with 57.8 g of DBE was heated at 85° C. for 4 hours. During this time an additional 50.1 g of 50% aq. NaOH was added to maintain the pH. At the end of the reaction period the solution was heated to boiling point for 1 hour then cooled to room temperature and 1633 g of water added. The solution was acidified with 36% HCl to pH 3 maintaining the temperature below 50° C. The solid product was collected by filtration. The solid product was (S,S) EDDS (51.5 g on 100% basis), representing a yield on L-aspartic acid charged of 31.3%, no other isomers being detected in the product. In the mother liquors was 85.7 g unreacted L-aspartic acid. The conversion of L-aspartic acid was 42.9% and selectivity to (s,s)EDDS was 72.8%.

ELECTROLESS COPPER PLATING SOLUTION

Typical electroless plating solutions are described in Industrial Electro-Chemistry (2nd Edition, 1990, published by Chapman Hall, in particular pages 426–429 thereof) by Derek Pletcher and Frank Walsh.

A typical generic electroless copper plating solution, which has a pH in the range of from pH 10–14 (typically 11–13.5) and which is used at a temperature of about 25° to 75° C. contains at least the following components:

copper sulphate formaldehyde sodium hydroxide

Rochelle salt

Chelate

For these studies the following protocol was adopted.

Copper films were electrolessly deposited on copper substrates in thermostatically controlled one kilogram plating baths equipped with a variable agitation system. The plating bath temperature and pH were monitored throughout the experimental period. The temperature range considered was 25° C. to 65° C. and the pH range considered was from 9 to 13.5. The plating solutions comprised copper sulphate, sequestering agent, sodium hydroxide, formaldehyde, potassium sodium tartrate and deionised water. The sequestering agents were EDTA, (s,s)EDDS (as prepared by the above mentioned process) or racemic EDDS (as prepared by the process of U.S. Pat. No. 3,158,635). A stabiliser, sodium cyanide, could be included at 10 ppm levels since CN is reported in U.S. Pat. No. 5,039,338 to inhibit $Cu_2O$ formation. The plating solution components were portioned prior to the experimental plating process to prevent the film growth commencing during the equilibration period. Typical compositions of the two portions were:

Solution A 0.375→2.00 mol sodium hydroxide 0.068→0.200 mol sequestering agent 0.05 mol potassium sodium tagate Deionised water to 500 g Solution B 0.075 mol copper sulphate 0.266 mol Formaldehyde Deionised water to 500 g The solutions A and B were warmed to the required temperature, combined, and pH adjusted before introduction to the pre-heated reactor. The copper substrate was then introduced into the plating solution. Thereafter intermediate weighings were performed at fifteen minutes intervals until the bath destabilised. The destabilisation of the bath was identified by the sudden amount of copper metal appearing in the bottom of the reactor and on the impeller blade. The colour of the usually bright blue solution could also change; becoming duller and more opaque. Once bath destabilisation occurred the plating solution pH and substrate weight were noted for the final time. The film growth rates were calculated from the substrate weight change.

The results of these studies (which are shown in Figures. FIGS. 2–5) show that with respect to activation energy plots the more biodegradable EDDS is comparable to EDTA (see FIGS. 2–3). This is advantageous as EDDS can replace EDTA in existing plating systems using EDTA.

Figure 3:
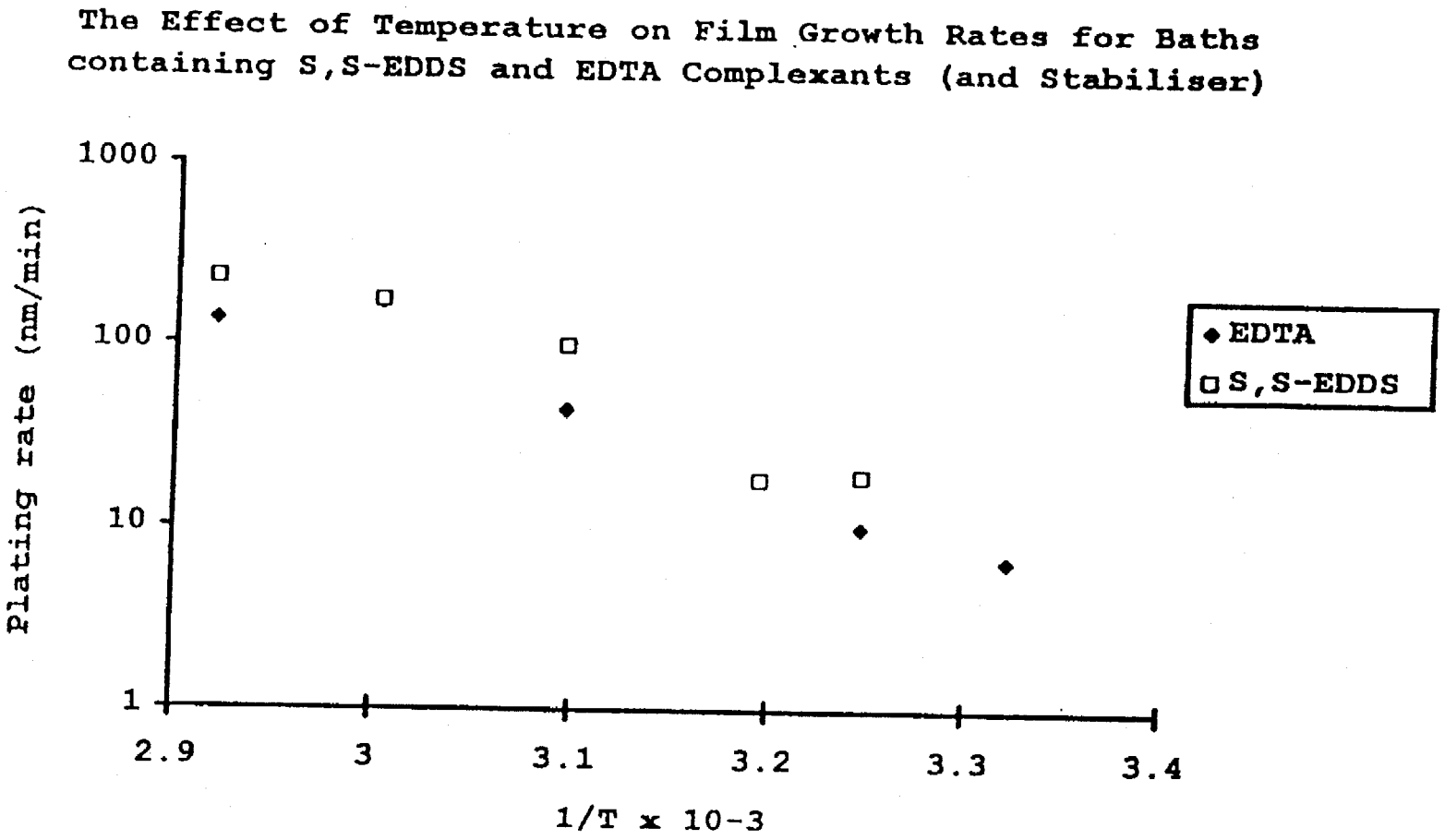

The results also show that with respect to the stability plots the more biodegradable EDDS is comparable to EDTA (see FIGS. 3–4). This is advantageous as it serves to show again that EDDS can replace EDTA in existing plating systems using EDTA.

Thus, the rate of copper deposition on the substrate was very favourable for the plating solution of the present invention, and was at least comparable to EDTA.

The stability of the electroless plating solution containing (s,s)EDDS was at least comparable to, for example, the electroless plating solutions containing just EDTA as the chelate.

The free (s,s)EDDS in the rinse water is biodegradable.

This copper plating solution is useful for depositing copper on a circuit board substrate.

METHOD OF DESTABILISATION SCREENING TEST

The relative resistance to destabilisation of an electroless plating bath is reflected in the destabilisation time. The shorter destabilisation time the more unstable the plating bath ie long destabilisation times are preferred. The screening test outlined below quantified and compared the relative stabilities of electroless plating baths employing (s,s)EDDS (as prepared by the process of PCT/GB94/02397) and racemic EDDS (as prepared by U.S. Pat. No. 3,158,635) as complexants.

The screening test minimised the variability introduced by glassware condition, particulate contamination, substrate surface and inconsistent bath preparation since these factors can influence the bath destabilisation.

A detailed description of the procedure employed now follows.

125 ml of solutions A and B were warmed to experimental temperature in separate, virgin, acid rinsed 600 ml glass beakers. The acid rinse and subsequent rinsing with copious quantities of deionised water was necessary to minimise the number of nucleation sites. When the desired operating temperature was reached the two solutions were combined in a third 600 ml beaker which was clamped in a thermostatically controlled water bath. The combined solution was unagitated and timed until destabilisation occurred. Destabilisation was evident by the presence of $H_2$ gas near the bath's surface, the presence of copper metal and the solution turning opaque.

The effect of the pH of the bath was studied for a [Chelant]:[$Cu^{2+}_{(aq)}$] ratio of 1.2:1. The results are presented in FIG. 6.

The results show that electroless plating solutions comprising (s,s)EDDS are better than electroless plating solutions comprising racemic EDDS over the pH range 11–13.

FURTHER STUDY

The results of a further destabilisation study are shown in FIG. 7 and in the Table shown below.

| pH | Temp (°C.) | (s,s)EDDS | Racemic EDDS | EDTA |
|---|---|---|---|---|
| 12.1 | 35 | 360 | 23 | 360 |
| 12.1 | 45 | 360 | 22 | 194 |

The results show that the stability of an electroless plating solution comprising (s,s)EDDS is as good as that comprising just EDTA. The results show that much better and surprising results are achieved with the use of (s,s)EDDS compared with the use of racemic EDDS.

Other modifications will be apparent to those skilled in the art.

I claim:

1. An electroless metal plating solution comprising metal ions to be reduced for plating onto a substrate and a chelate for the metal ions to prevent or reduce metal hydroxide precipitates forming and to buffer the amount of metal ions available for reduction wherein the chelate is at least ethylene diamine disuccinic acid.

2. A process of plating a substrate with a metal comprising exposing the substrate to the electroless metal plating solution defined in claim 1.

3. The invention according to claim 2 wherein said ethylene diamine disuccinic acid is (s,s) ethylene diamine disuccinic acid.

4. The invention according to claim 3, wherein the metal ions are to be reduced to copper ions.

5. The invention according to claim 2, wherein the metal ions to be reduced are copper ions.

6. The invention according to claim 1 wherein said ethylene diamine disuccinic acid is (s,s) ethylene diamine disuccinic acid.

7. The invention according to claim 6, wherein the metal ions to be reduced are copper ions.

8. The invention according to claim 1, wherein the metal ions to be reduced are copper ions.

9. A process of plating a substrate with a metal comprising exposing the substrate to an electroless metal plating solution comprising ethylene diamine disuccinic acid as a biodegradable chelate.

10. The invention according to claim 9 wherein said ethylene diamine disuccinic acid is (s,s) diamine disiccinic acid.

11. The invention according to claim 10, wherein the metal ions to be reduced are copper ions.

12. The invention according to claim 9, wherein the metal ions to be reduced are copper ions.

* * * * *